United States Patent [19]

Sferle

[11] Patent Number: 4,468,025

[45] Date of Patent: Aug. 28, 1984

[54] EXERCISE BENCH

[76] Inventor: Mihai Sferle, 147-25 10th Ave., Whitestone, N.Y. 11357

[21] Appl. No.: 424,598

[22] Filed: Sep. 27, 1982

[51] Int. Cl.[3] ..... A63B 21/00

[52] U.S. Cl. ..... 272/120; 272/93; 272/72; 272/73; 272/134; 272/144

[58] Field of Search ..... 272/120, 142, 144, 137–138, 272/72, 73, 145, 134, 93; 5/63, 76, 412, 510, 511; 128/25 R

[56] References Cited

U.S. PATENT DOCUMENTS

| | | | |
|---|---|---|---|
| 2,548,408 | 4/1951 | Tammen | 272/144 X |
| 3,892,404 | 7/1975 | Martucci | 272/120 X |
| 3,904,196 | 9/1975 | Berlin | 272/72 |
| 4,004,801 | 1/1977 | Campanaro et al. | 272/120 |
| 4,101,124 | 7/1978 | Mahnke | 272/145 X |
| 4,272,074 | 6/1981 | Sferle | 272/120 |

FOREIGN PATENT DOCUMENTS

| | | | |
|---|---|---|---|
| 369451 | 3/1939 | Italy | 272/134 |

*Primary Examiner*—Richard J. Apley
*Assistant Examiner*—Chris Coppens
*Attorney, Agent, or Firm*—Howard M. Schwinger

[57] ABSTRACT

In a body building apparatus wherein the user is positioned on a cable connected inclinable bench which he moves against his weight by stressing the cables, a back rest for the bench permitting the user to assume a rowing, cycling and other positions.

3 Claims, 3 Drawing Figures

EXERCISE BENCH

This invention relates to a device for body building and more particularly to a cable connected inclinable exercise bench which the user moves against his weight by pulling upon cables.

Introduction

Exercise benches offer a multitude of body building possibilities which have heretofore been overlooked, the conventional benches failing to fully exploit the possibilities offered.

It is therefore amongst the primary objects of this invention to provide an exercise bench which more fully takes advantage of what such a bench can offer for the development of the body.

This and other objects will become apparent from a reading of the following specification.

THE DRAWING

FIG. 3 is a view of the other end of this embodiment showing the crank assembly.

DETAILED DESCRIPTION

Figure 1:
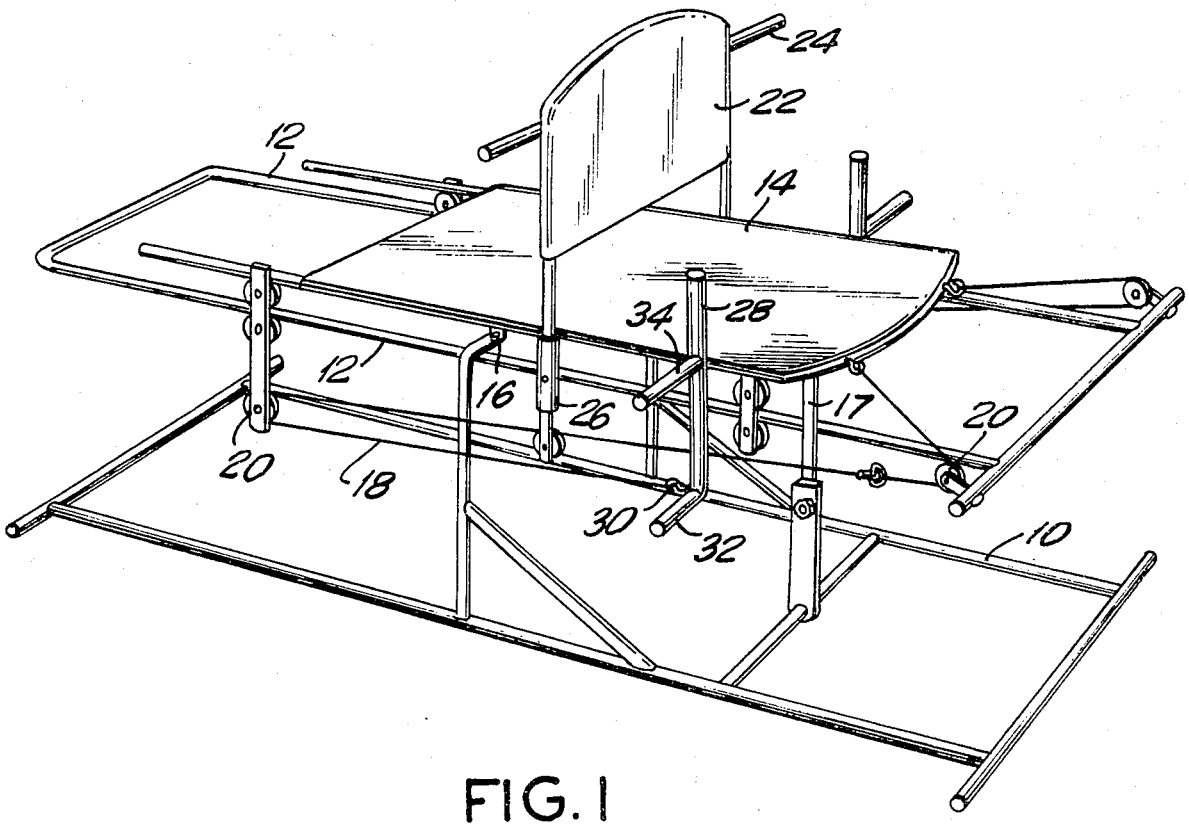
FIG. 1 is a perspective view of an exercise bench in accordance with the present invention.

In FIG. 1 an embodiment of the exercise bench of this invention is shown consisting of frame 10 which includes, amongst other elements, rails 12 on which bench 14 may be moved. The bench and immediate supporting structure may be rotated at 16 and thereby inclined as desired. Jack 17 is provided for maintaining the bench at the inclination desired. Cables 18 and associated pulleys 20 provide the means for moving the bench when weighted by the user 19. The freely moving bench is moved when pulled by the cables which in turn are pulled by the user. Such an arrangement was disclosed in my U.S. Pat. No. 4,272,074, and is typical of conventional exercise benches. However, in this instance the cables are not pulled by conventional handgrips but as described below.

Back rest 22 provided with hand grips 24 is removably set in mountings 26. The back rest may be removed from said mounting and placed in a second set of mountings 28 which is in operative interconnection with the cables at 30. In this position the back rest will normally be forward of the user and by means of the hand grips a rowing attitude may be assumed. Mounting 28 is movably mounted on the bench frame so as to ride with the user as he exercises.

It thus may be seen that the user will sit upon the bench of the present invention with his legs dangling over the sides. If rest 22 is positioned in mounting 28, which is in operative interconnection with the cables, the user will sit with the rest in front of him and use its handles 24 to effect a rowing attitude.

If rest 22 is positioned in mountings 26, the user will use the rest as a back rest and movement of the bench will be obtained by the interaction of his dangling legs with the foot pulls 32.

Figure 2:
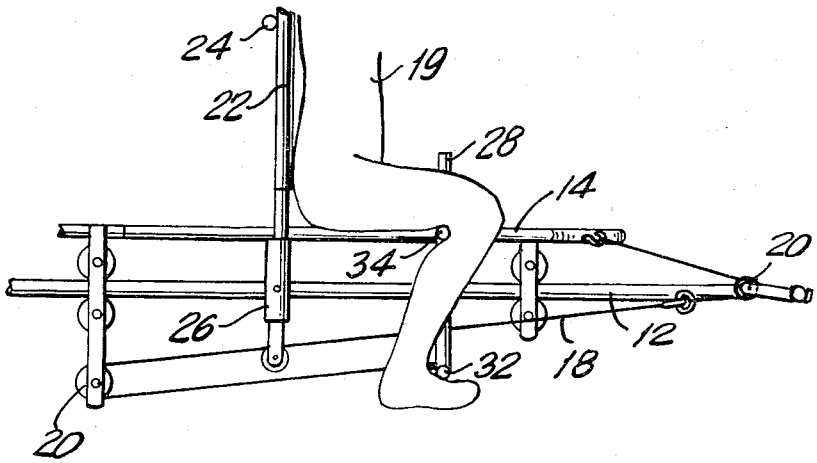
FIG. 2 is a view of one end of the bench illustrating one of its uses.

A foot pull for operating the bench is provided at the lower end of each mounting 28 which is elongated to carry it. The foot pull may engage the front of the user's ankle when he sits upon the bench with his legs dangling over the sides. A leg support 34 may also be provided on movable mounting 28, which is in interaction with cable 18. As may be seen this support is designed to engage the back of the user's knee. FIG. 2 illustrates how these elements may be utilized to operate the bench with the front of the ankle applying the force to move the bench.

As may be seen in FIG. 3, a pedaling assemblage is provided at one end of the bench mounted transversely across rails 12. The assembly consists of crank 40 having foot pedals 42 at its offset ends. The crank is rotatably supported by brackets 44 which are movably affixed to the rails. Disc 46 centrally mounted on crank 40 is designed to be moved to engage stationary friction plate 48 as pressure is exerted on the pedals. The user may sit with his back against the rest and his feet upon the pedals. Thus when the user increases pressure on the pedals disc 46 will make contact with friction plate 48 and hence, more force will be required to pedal enhancing the exercising effect. The disc may be of brake lining material or any other frictional composition. The back rest should be employed in carrying out the cycling attitude.

Bar bell 50 is secured to one end of the bench frame to increase the weight against which the user has to work, as shown in FIG. 3. The bar bell may be secured by clamping its weights against the tracks on which the bench moves.

It may thus be seen that the exercise bench of the present invention offers physical attitudes for exercising heretofore not contemplated by existing devices. It should also be realized that only a few of the many possibilities have been described here and only one of several embodiments has been shown. It will be further understood that arms, legs, ankles, neck, back and abdomen in particular will be benefited by the instant device.

Depending upon the position the user desires to assume, he will either position rest 22 in mounting 26 or 28. The tubular legs of the rest are adapted to be inserted into either of the tubular mountings. When inserted into mounting 28, which is movably mounted on the bench frame, movement of the rest will cause the bench to move. As may be seen, the mounting is connected with cable 18 at 30. Movement of the mounting will cause movement of the cable which in turn will move the bench. A rowing attitude may be assumed in this position with the rest forward of the user. When position in mounting 26, the rest is used strictly as a back rest. This will be the case when it is desired to move the bench by foot pull 32 or for pedaling. It may be seen that foot pull 32 extends from the lower portion of mounting 28 which is connected with cable 18 at 30.

I claim:

1. A body building apparatus comprising a frame, a bench, support means on said frame for adjustably mounting said bench thereto in a plurality of inclined positions, pulley means mounted on said frame, cable means operatively connected to said pulley means and said bench so as to move said bench against the user's weight by stressing said cable, a back rest adjustably mounted on said bench so as to be positionable into a plurality of positions, wherein one of said positions said back rest is mounted behind the user and not in operative interconnection with the cable and in a second position said back rest is mounted forward of the user and in operative interconnection with the cable for stressing said cable.

2. An apparatus in accordance with claim 1 wherein said back rest is provided with hand grips permitting a rowing attitude when cable connected.

3. An apparatus in accordance with claim 2 having leg grips depending downwardly on each side of the bench connecting bench with cable, said grip comprising abutment means for the front of the ankle enabling the user to move the bench by pushing with the front of the ankle.

* * * * *